US006607085B2

(12) United States Patent
Pavlic

(10) Patent No.: US 6,607,085 B2
(45) Date of Patent: Aug. 19, 2003

(54) CLOSET HIDING PLACE

(76) Inventor: Michael Thomas Pavlic, 4992 Wickford Way, Atlanta, GA (US) 30338

( * ) Notice: Subject to any disclaimer, the term of this patent is extended or adjusted under 35 U.S.C. 154(b) by 0 days.

(21) Appl. No.: 09/923,729

(22) Filed: Aug. 7, 2001

(65) Prior Publication Data

US 2003/0029819 A1 Feb. 13, 2003

(51) Int. Cl.[7] ..... A47F 5/08
(52) U.S. Cl. ..... 211/86.01; 52/287.1; 52/716.1
(58) Field of Search ..... 211/86.01, 87.01; 52/287.1, 288.1, 11, 716.1; 248/298.1

(56) References Cited

U.S. PATENT DOCUMENTS

| | | | | |
|---|---|---|---|---|
| 375,574 A | | 12/1887 | Shannon | |
| 513,061 A | | 1/1894 | Slater | |
| 1,023,425 A | | 4/1912 | Harrison | |
| 1,161,189 A | | 11/1915 | Coleston | |
| 1,509,285 A | | 9/1924 | Colbon | |
| 2,086,018 A | | 7/1937 | Dyer | |
| 3,717,112 A | | 2/1973 | Welty | |
| 4,083,314 A | | 4/1978 | Garvin | |
| 4,821,652 A | | 4/1989 | Hoffman | |
| 5,066,079 A | | 11/1991 | Lawrence | |
| 5,586,934 A | | 12/1996 | Dombrowski et al. | |
| 5,605,264 A | * | 2/1997 | Neal | 224/404 |
| 5,924,259 A | * | 7/1999 | Marousek | 52/287.1 |
| 6,146,048 A | * | 11/2000 | Stibolt | 403/313 |
| 6,421,979 B1 | * | 7/2002 | Fischer et al. | 52/716.7 |
| 6,435,359 B1 | * | 8/2002 | Priminano | 211/88.01 |

* cited by examiner

*Primary Examiner*—Daniel P. Stodola
*Assistant Examiner*—Erica B. Harris

(57) ABSTRACT

The closet hiding place includes a plurality of telescopic channels that can be adjusted relative to each other to extend the length of a wall above a closet door. The channels are either generally rectangular or semicircular with an open top and simulate a duct when installed in a closet. The channels are mounted to the wall by the extension of fasteners through slots along the upper edge of the back wall of each channel. The front and bottom walls are longer than the back wall to enable the channel to sit flush against the wall. The open top enables a user to place items in the channels to obscure the items from the view of unauthorized persons such as thieves or small children.

3 Claims, 2 Drawing Sheets

CLOSET HIDING PLACE

BACKGROUND

1. Field of Invention

This invention relates to cabinet structures, household devices with secret compartments, and safes.

2. Description of Prior Art

Many inventions for the home have secret compartments. Furniture with secret compartments is expensive, complicated, and limited to small items.

U.S. Pat. No. 3,717,112 to Welty (1973) discloses a compartment within a door hinge that is expensive and complicated. It requires lengthy installation, is limited to small items and cannot be easily uninstalled and taken to another home.

U.S. Pat. No. 4,821,652 to Hoffman (1989) discloses a device masquerading as cold air return which is limited to small items. It requires elaborate construction into a house wall and cannot be easily uninstalled and taken to another home.

U.S. Pat. No. 5,586,934 to Dombrowski (1996) discloses a cold air return with a secret compartment. It is limited to hiding small items. The flow of air can introduce dirt and moisture to the valuables. Elaborate construction may be required to match the new air return to the existing vents. It cannot be easily uninstalled and taken to another home.

U.S. Pat. No. 6,135,034 to Clark (2000) discloses a trashcan safe that is expensive, complicated, and limited to small items. Moisture and dirt may damage valuables and papers.

U.S. Pat. No. 5,066,079 to Lawrence (1991) discloses a compartment within a door. It requires elaborate construction, holds little, and requires refinishing the door to hide the secret additions. It also cannot be easily uninstalled and taken to another home.

U.S. Pat. No. 4,083,314 to Garvin (1978) discloses a wall depository that imitates an electrical outlet holds little. It cannot not be easily uninstalled and taken to another home.

Can safes hold little, and have been discarded when the can appears old.

U.S. Pat. No. 2,086,018 to Dyer (1937) discloses a refrigerator with a depository that is expensive and may damage valuables with moisture.

Gun safes are expensive, large, ugly and very heavy. They are slow to open. They are rarely close to a sleeping homeowner.

Gun cabinets are large and expensive pieces of furniture. They seldom fit into a bedroom. They are less secure than a safe and are not quickly opened.

OBJECTS AND ADVANTAGES

The Closet Hiding Place hides valuables, personal items and dangerous items. It is inexpensive. It is simple in construction. It is trivial to install. It is very quick to load and unload. It may be easily installed and easily uninstalled in a rental property.

The Closet Hiding Place has more volume than most secret compartment devices. It is long enough to hold one or more rifles. There are no locks to slow the acquisition of any contents, including a firearm. A closet is a clean dry place. Many secret compartment devices in external house walls allow moisture condensation onto valuables.

The Closet Hiding Place is usually installed in a closet above the door. This poorly illuminated area is unobtrusive and inconspicuous. Many closets have little space to stand and see the area above the doorway. The Closet Hiding Place is installed in an area where nothing is traditionally placed. A burglar would need to carry a flashlight to discover the Closet Hiding Place.

Installing one in many closets would increase the time a burglar searches. He would need to carry something to stand on from room to room. This would decrease the amount of loot he could carry. A Closet Hiding Place in a child's room or a laundry room would be unexpected. Water heater rooms, utility rooms, kitchen cupboards or linen closets would be unexpected. The Closet Hiding Place is usually attached to a wall by screws and can also be attached by Velcro or hooks. The Closet Hiding Place and its contents can then be removed in an instant.

SUMMARY

The Closet Hiding Place can assume the appearance of many ordinary building materials. It may look like a cylindrical or rectangular air duct. It may imitate a water pipe or whatever building instrumentality comes into vogue. It is installed inside a closet above the closet's door. The Closet Hiding Place will extend to fit the width of a closet. Adding additional nesting channels will accommodate the width of any closet. One channel may be cut to fit the width of a narrow closet. The Closet Hiding Place will conceal valuable, dangerous and private items.

DRAWINGS

Drawing Figures

REFERENCE NUMERALS IN DRAWINGS

Figure 1:
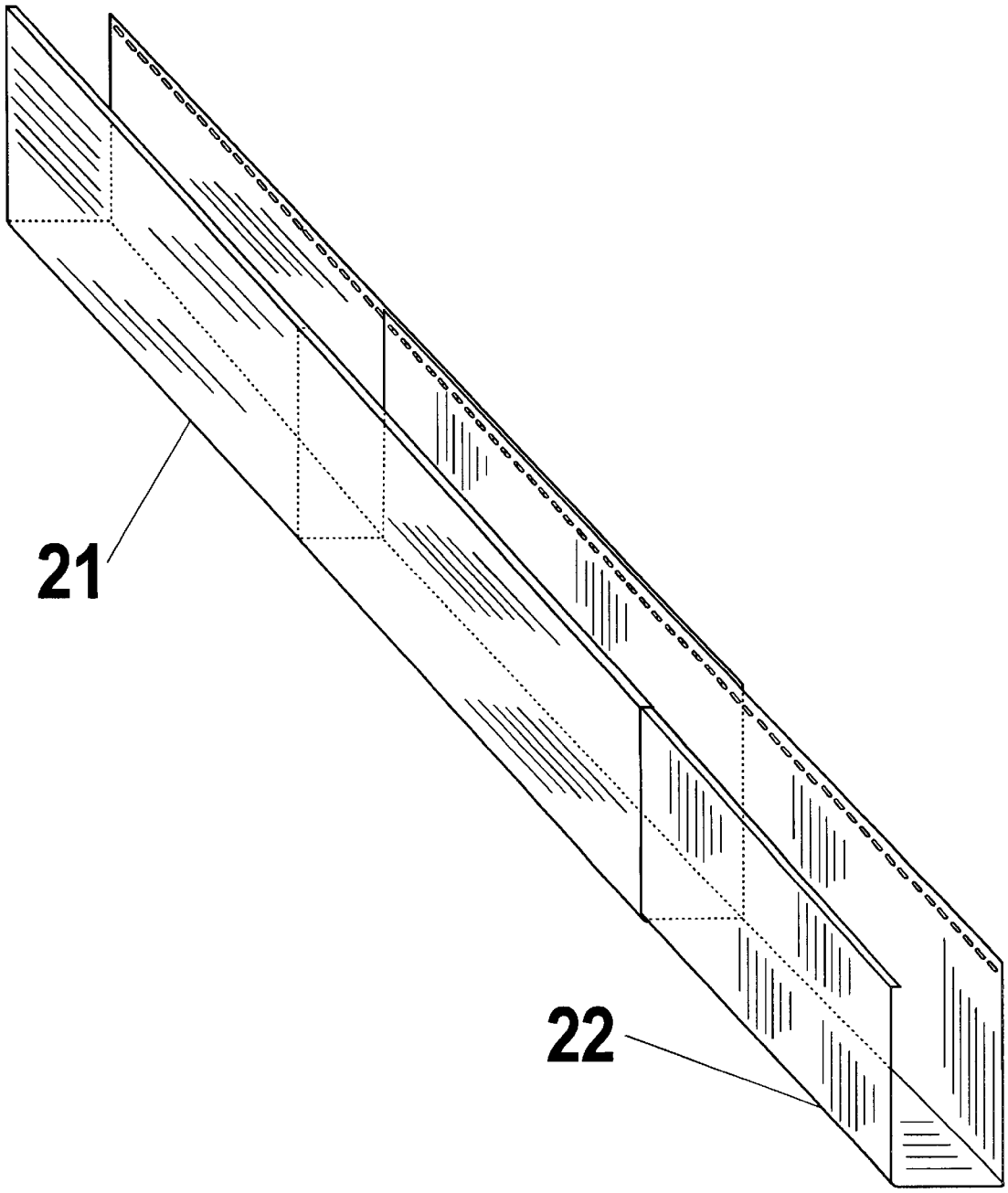
FIG. 1 shows a perspective view of the Closet Hiding Place.
Figure 2:
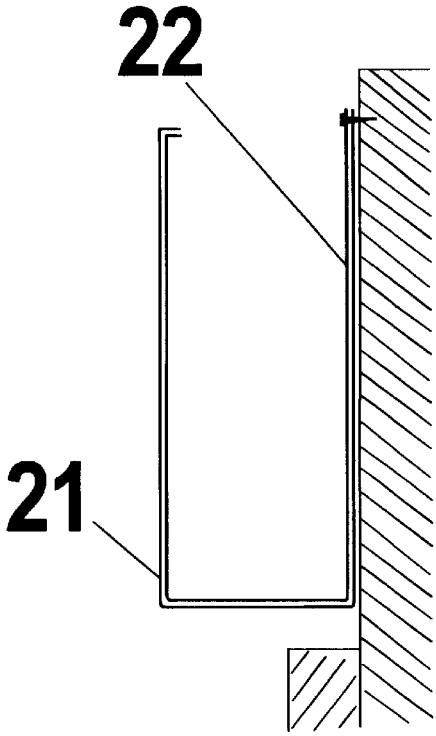
FIG. 2 shows an end view of the Closet Hiding Place.
Figure 4:
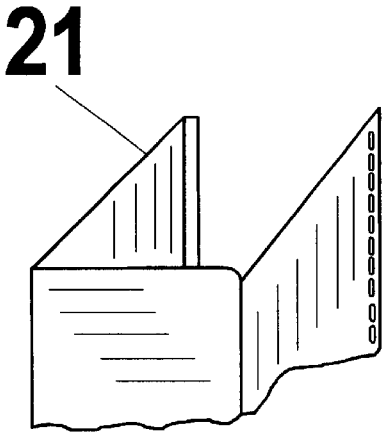
FIG. 4 shows a perspective view of the end of a channel.

21 a channel shown in FIG. 1, FIG. 2, and FIG. 4

22 a slightly smaller channel than channel 21 shown in FIG. 1 and FIG. 2

Figure 3:
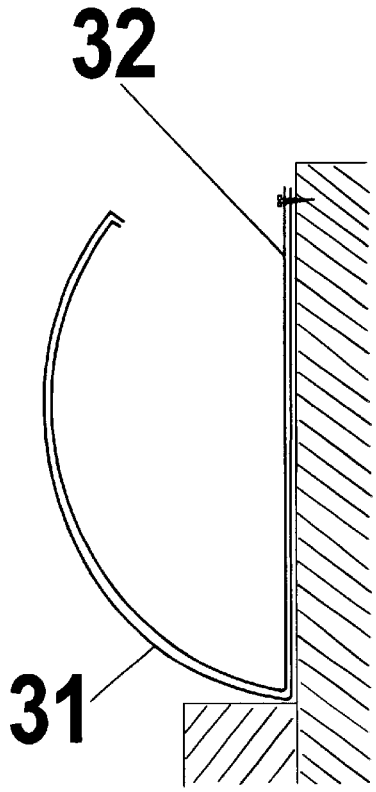
FIG. 3 shows an end view of the Closet Hiding Place. This embodiment has the appearance of a cylindrical air duct or a water pipe.

31 a channel shown in FIG. 3

32 a slightly smaller channel than channel 31 shown in FIG. 3

DETAILED DESCRIPTIONS

Descriptions—FIGS. 1 and 2—Preferred Embodiment

FIG. 1 shows a perspective view of a rectangular embodiment of the Closet Hiding Place. FIG. 2 shows a side view of the rectangular embodiment of the Closet Hiding Place. The Closet Hiding Place is in the form of a channel or gutter. It is attached inside a closet and over the closet's door. The Closet Hiding Place consists of two channels 21 and 22. Channel 22 is slightly smaller than channel 21. The pair can be easily nested and extended across the width of a closet. Screws are inserted through the slots in channel 21 and 22 and into the closet wall. This will attach the Closet Hiding Place above the closet door. When viewed, the Closet Hiding Place will appear to be a rectangular air duct. The Closet Hiding Place will rarely be noticed. People seldom look backward to see what is above a closet's door. Usually there is little light illuminating the area above the door of a closet. If the Closet Hiding Place is noticed it will be recognized as an ordinary rectangular air duct. The Closet Hiding Place may be made from bent sheet metal or plastic channels. The visible face mimics the side of a rectangular air duct.

The Closet Hiding Place can be made any length by nesting an unlimited number of channels. Duct tape over the intersections of the channels can be added for realism. The Closet Hiding Place may be installed during new construction, taped and painted as wallboard. It will then appear to be an ordinary wallboard structure. A single channel may be may be cut to fit a narrow closet.

FIG. 3 Additional Embodiments

Channels 31 and 32 as seen in FIG. 3 mimic the side of a cylindrical air duct. Channels may be colored to mimic a water pipe. Other embodiments can mimic additional building artifices.

FIG. 4 Bottom View

The ends of all channels conform to the curve between adjacent closet walls. The wall side of channels is shortened. Channel bottom fillets match the fillets between adjacent closet walls.

Advantages

From the description above, many advantages of the Closet Hiding Place become evident:

(a) It is hidden in one of the least discoverable areas of a house.

(b) It looks like an uninteresting air duct.

(c) It holds items out of reach of small children.

(d) It can be installed in any room with a closet.

(e) It can be installed by anyone who can hang a picture.

(f) It can be installed in the time it takes to hang a few pictures.

(g) It holds a large volume of valuables.

(h) It will hold long items like shotguns or rifles.

(i) It is inexpensive enough to be installed in many closets.

(j) It can be uninstalled in a few minutes and taken to another home.

(k) Items can be loaded and unloaded quickly without the delay of locks.

OPERATION—FIGS. 1, 2, 3

Dangerous, valuable, and private articles are lowered into the open top of the Closet Hiding Place. Articles are removed by lifting them out from the top of the Closet Hiding Place. Long items like a rifle can be placed and quickly retrieved from the Closet Hiding Place.

CONCLUSIONS, RAMIFICATIONS, AND SCOPE

The Closet Hiding Place is easy for a homeowner to install with a screwdriver. It does not take up any otherwise necessary room. It is installed in an area unused by anything else. This area is unused because it is poorly illuminated and difficult to reach. The Closet Hiding Place is unreachable by young children. It is an ideal hiding place. A bedroom Closet Hiding Place can hold firearms that can be quickly retrieved.

The Closet Hiding Place may be installed in unlikely innovative areas. These include a child's closet, laundry rooms, water heater rooms and utility rooms. Kitchen cupboards or linen closets are also unexpected areas. The Closet Hiding Place is so inexpensive that many can be installed throughout a house.

I claim:

1. A hidden compartment for holding and concealing objects above a door within a rectangular closet, and the compartment has the appearance of an ordinary rectangular air duct that appears to extend through the closet sidewalls and appears to be partially imbedded within the wall above the closet door, said compartment comprising:

(a) a plurality of elongated substantially U shaped contiguous channels of two slightly differing sizes such that the channels may be nested and telescope relative to one another;

(b) each channel having a back portion including a plurality of slots juxtaposed a top edge thereof, a bottom portion, and a front portion with a small lip bent along a top edge thereof;

(c) said bottom and front portions are longer than said back portion, which is to be attached to the wall above the closet door by fastening members extending through the slots into structures located behind the closet wall and said bottom and front portions being extended tightly between both closet sidewalls such that the channels appear to extend through the closet sidewalls;

(d) said back portion being shorter than said front and bottom portions to create a gap to accommodate any small irregularity formed between said closet sidewalls and the closet wall above the door to enable said back portion to sit flush against said wall above said closet door;

(e) said back portion is taller than said front portion to facilitate attachment to the wall above said closet door;

(f) the ends of said bottom portion adjacent to said back portion having a small curve joining said bottom portion to said back portion to accomodate any small irregularity formed between said closet sidewalls and the closet wall above the door to further enable said channel to sit flush against said wall above said closet door; and (g) said small lip on said front portion, when viewed from inside said closet, extends from said front portion toward said back portion and keeps the channels nested together.

2. The hidden compartment of claim 1 may be installed in other areas with a wall ending in perpendicular sidewalls, and the secret compartment of claim 1 may be installed by taping and painting so it appears to be an ordinary building structure.

3. The hidden compartment of claim 1 has an alternate embodiment with the appearance of a round air duct or water pipe with a curved side replacing said bottom and said front.

* * * * *